US009470120B2

(12) United States Patent
Mitsutani

(10) Patent No.: US 9,470,120 B2
(45) Date of Patent: Oct. 18, 2016

(54) VALVE TIMING CONTROL APPARATUS

(71) Applicant: DENSO CORPORATION, Kariya, Aichi-pref. (JP)

(72) Inventor: Tetsurou Mitsutani, Chiryu (JP)

(73) Assignee: DENSO CORPORATION, Kariya (JP)

( * ) Notice: Subject to any disclaimer, the term of this patent is extended or adjusted under 35 U.S.C. 154(b) by 75 days.

(21) Appl. No.: 14/479,548

(22) Filed: Sep. 8, 2014

(65) Prior Publication Data

US 2015/0075460 A1 Mar. 19, 2015

(30) Foreign Application Priority Data

Sep. 17, 2013 (JP) ..... 2013-191551

(51) Int. Cl.
*F01L 1/34* (2006.01)
*F01L 1/344* (2006.01)

(52) U.S. Cl.
CPC ..... *F01L 1/3442* (2013.01); *F01L 2001/3443* (2013.01); *F01L 2001/3445* (2013.01); *F01L 2001/34423* (2013.01); *F01L 2001/34426* (2013.01); *F01L 2001/34433* (2013.01)

(58) Field of Classification Search
CPC ..... F01L 1/3442; F01L 2001/34423; F01L 2001/34433; F01L 2001/3445
USPC ..... 123/90.17
See application file for complete search history.

(56) References Cited

U.S. PATENT DOCUMENTS

| | | | |
|---|---|---|---|
| 7,533,695 | B2 | 5/2009 | Strauss et al. |
| 2005/0284433 | A1 | 12/2005 | Yaoko et al. |
| 2007/0095315 | A1 | 5/2007 | Hoppe et al. |

FOREIGN PATENT DOCUMENTS

| | | |
|---|---|---|
| DE | 100 29 261 | 12/2001 |
| JP | 2014-156810 | 8/2014 |

OTHER PUBLICATIONS

Office Action (4 pages) dated Jul. 21, 2015, issued in corresponding Japanese Application No. 2013-191551 and English translation (4 pages).
Office Action (3 pages) dated Feb. 23, 2016, issued in corresponding Japanese Application No. 2013-191551 and English translation (2 pages).

*Primary Examiner* — Zelalem Eshete
(74) *Attorney, Agent, or Firm* — Nixon & Vanderhye P.C.

(57) ABSTRACT

A spool has a connection passage that connects a supply port and a discharge port with each other according to a position of the spool in an axial direction. A valve seat is arranged in the connection passage. The connection passage has a supply hole passing through the spool in a radial direction, and a discharge hole passing through the spool in the radial direction. The spool has a guide surface that guides a valve object to move in the axial direction while restricting a position of the valve object in the radial direction. The discharge hole is opened on the guide surface.

10 Claims, 11 Drawing Sheets

VALVE TIMING CONTROL APPARATUS

CROSS REFERENCE TO RELATED APPLICATION

This application is based on Japanese Patent Application No. 2013-191551 filed on Sep. 17, 2013, the disclosure of which is incorporated herein by reference in its entirety.

TECHNICAL FIELD

The present disclosure relates to a valve timing control apparatus.

BACKGROUND

A valve timing control apparatus controls valve timing of an intake/exhaust valve by changing a rotation phase between a crankshaft and a camshaft of an internal combustion engine. A hydraulic valve timing control apparatus is equipped with a housing rotating with a crankshaft and a vane rotor rotating with a camshaft. The vane rotor defines an advance chamber and a retard chamber in the housing. The vane rotor is advanced or retarded relative to the housing by operation oil supplied to the advance chamber or the retard chamber. The operation oil is supplied by a direction switch valve. The advance chamber and the retard chamber may be referred to oil pressure chamber.

U.S. Pat. No. 7,533,695 B2 describes a direction switch valve for a valve timing control apparatus, and the direction switch valve is a spool-type valve disposed at the central part of the vane rotor. The spool of the direction switch valve has a connection passage which connects an oil pump and an oil pressure chamber according to an axial position of the spool. A check valve is arranged in the connection passage, and is distanced from a discharge hole in the axial direction. The discharge hole is an oil exit of the connection passage.

The check valve includes a cylindrical valve body fixed to the inner wall of the connection passage, a valve seat fixed to the valve body, and a spherical valve object seating on or separating from the valve seat. The check valve restricts operation oil from flowing toward the oil pump from the oil pressure chamber. Thus, when operation oil is supplied to the oil pressure chamber from the oil pump, the operation oil can be restricted from returning from the oil pressure chamber to the oil pump if alternating torque acts on the vane rotor, for example, due to spring reaction force of an intake/exhaust valve.

A clearance is defined between the valve body and the valve object of the check valve, and operation oil flows through the clearance when the valve object is separated from the valve seat. The clearance enlarges the size of the check valve in the radial direction, and enlarges the size of the direction switch valve as a result.

Moreover, the valve-closing part, i.e., the valve seat and the valve object, of the check valve is arranged to distance from the discharge hole in the axial direction, in the connection passage. Therefore, it takes time to close the check valve when operation oil flows backwards from the oil pressure chamber toward the oil pump.

SUMMARY

It is an object of the present disclosure to provide a valve timing control apparatus in which a direction switch valve is downsized and response of a check valve is improved in a spool of the direction switch valve.

According to an aspect of the present disclosure, a valve timing control apparatus includes a housing, a vane rotor, a sleeve, a spool, a valve seat, and a valve object. The housing can be rotated with one of a driving shaft and a driven shaft of an internal combustion engine. The vane rotor can be rotated with the other of the driving shaft and the driven shaft. The vane rotor defines an oil pressure chamber inside the housing, and is rotated relative to the housing by operation oil supplied to the oil pressure chamber.

The sleeve has a cylindrical shape extending in the axial direction at the central part of the vane rotor. The sleeve has a supply port communicating with an external oil supply source, and a discharge port communicating with the oil pressure chamber. The spool is movable in the axial direction inside the sleeve, and has a connection passage which connects the supply port and the discharge port according to an axial position of the spool. The valve seat is arranged in the connection passage. The valve object is seated on or separated from the valve seat. When the valve object is seated on the valve seat, the operation oil is restricted from flowing from the discharge port to the supply port.

The connection passage has a first axial direction hole, a supply hole, a second axial direction hole, and a discharge hole. The first axial direction hole is extended to one side in the axial direction relative to the valve seat. The supply hole passes through the spool in a radial direction from the first axial direction hole so as to communicate with the supply port. The second axial direction hole is extended to the other side in the axial direction relative to the valve seat. The discharge hole passes through the spool in the radial direction from the second axial direction hole. The discharge hole communicates with the discharge port according to a position of the spool in the axial direction. The second axial direction hole has a guide surface that guides the valve object to move in the axial direction while restricting a position of the valve object in the radial direction. The discharge hole is opened on the guide surface.

Accordingly, when the valve object is separated from the valve seat, operation oil can flow into the oil pressure chamber through a portion of the discharge hole that is opened at a position adjacent to the valve seat with respect to a slide move part defined between the valve object and the guide surface. Therefore, the check valve can be constituted without providing a clearance between the guide surface and the valve object. Therefore, the check valve can be downsized in the radial direction, and the direction switch valve can be downsized.

Moreover, the valve seat and the valve object are arranged at approximately the same position in the axial direction as the discharge hole, in the connection passage. Therefore, when operation oil flows backwards from the oil pressure chamber toward the oil pump, variation in oil pressure is transmitted to the check valve comparatively for a short time. Thus, the response of the check valve can be improved.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

An embodiment is described with reference to FIGS. 1-11.

Figure 1:
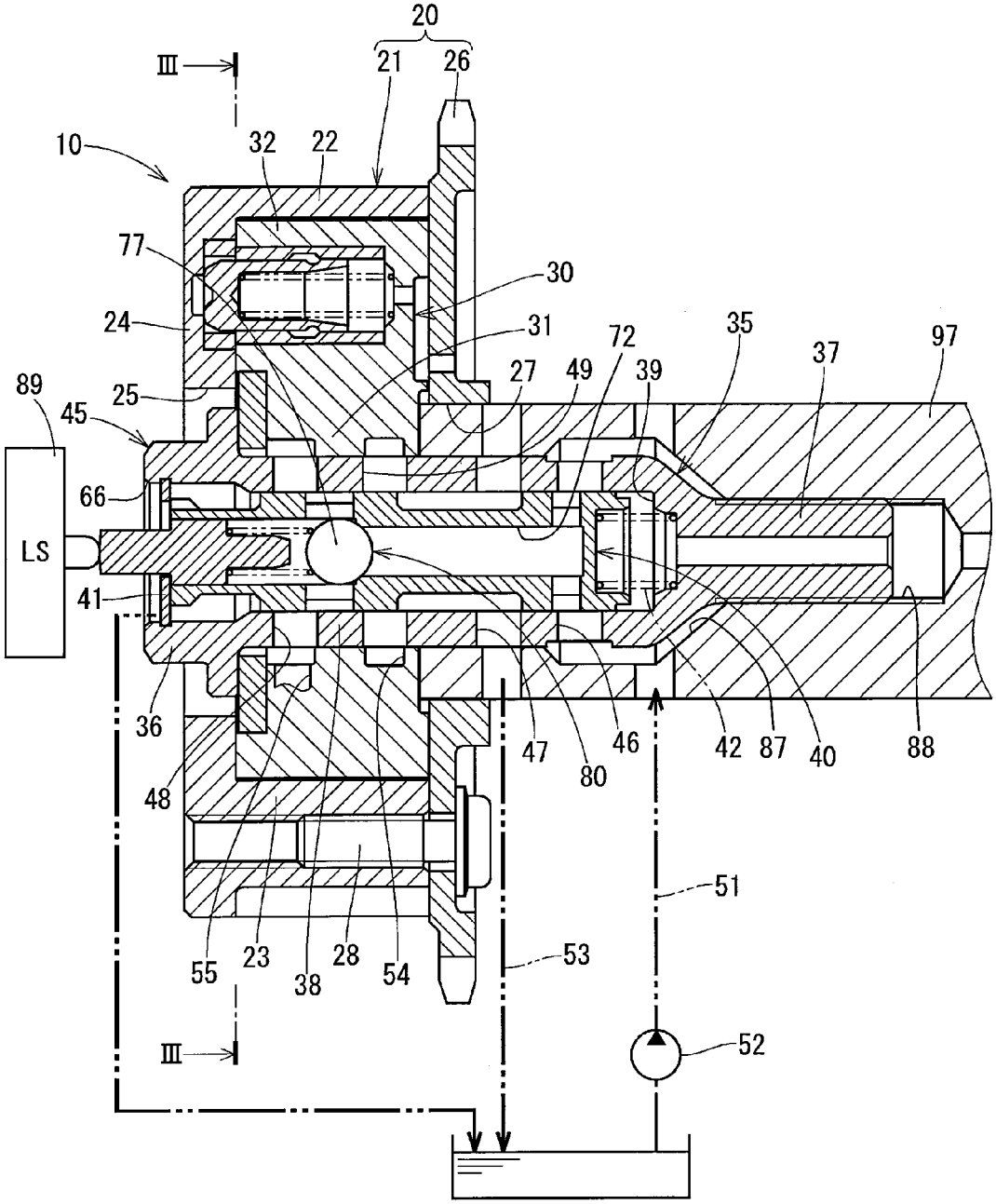
FIG. 1 is a schematic sectional view illustrating a valve timing control apparatus according to an embodiment.
Figure 2:
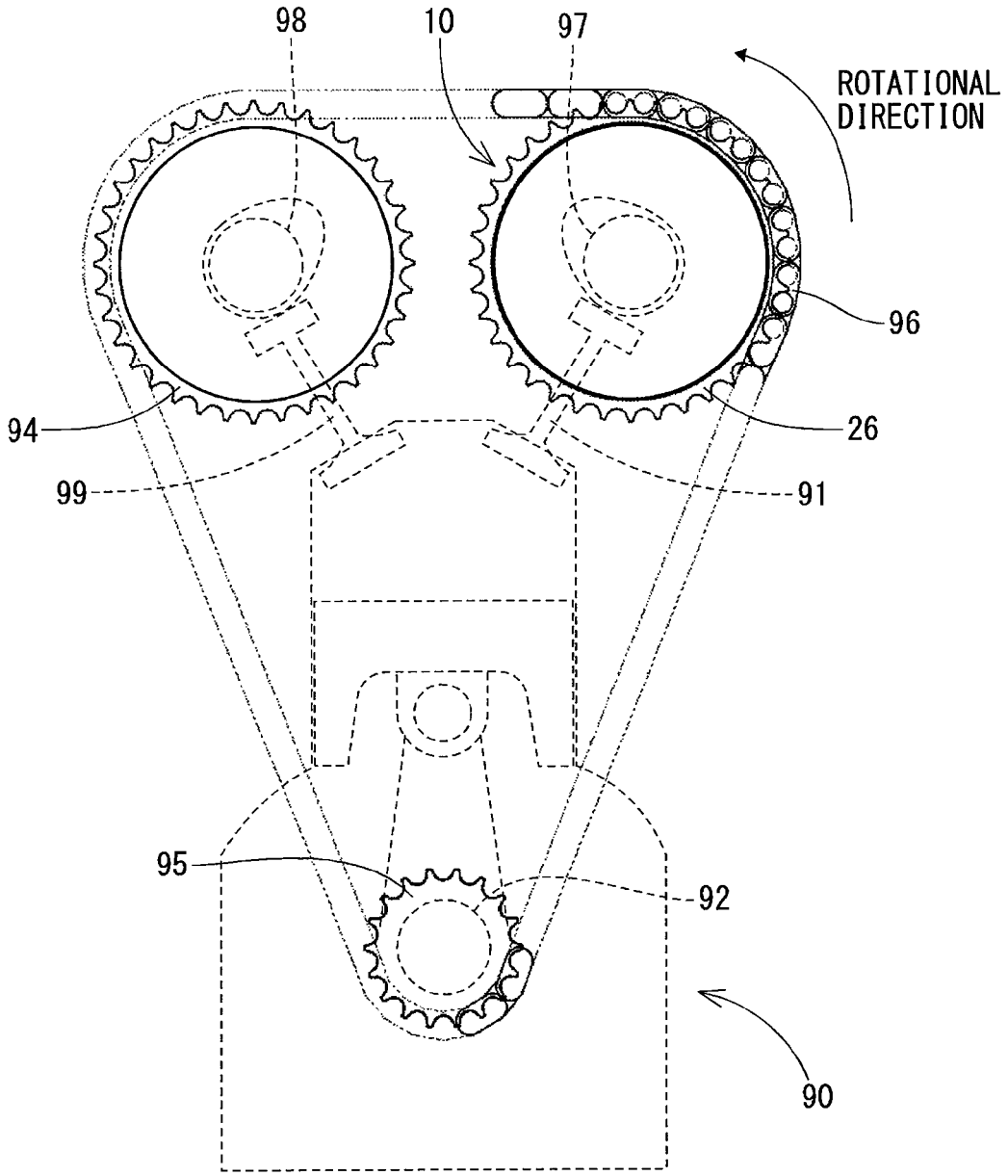
FIG. 2 is a schematic view illustrating an internal combustion engine having the valve timing control apparatus.

A valve timing control apparatus 10 of the embodiment is shown in FIG. 1. The valve timing control apparatus 10 controls opening-and-closing timing of an exhaust valve 91 of an internal combustion engine 90 shown in FIG. 2. As shown in FIG. 2, rotation of a crankshaft 92 (driving shaft) of the engine 90 is transmitted to camshafts 97 and 98 through a chain 96 engaged with sprockets 26, 94, and 95. The camshaft 97 is a driven shaft which drives the exhaust valve 91 to open and close, and the camshaft 98 is a driven shaft which drives an intake valve 99 to open and close.

The valve timing control apparatus 10 advances the opening-and-closing timing of the exhaust valve 91 by rotating the camshaft 97 in a rotational direction shown in FIG. 2 relative to the sprocket 95 which rotates with the crankshaft 92. The advance operation is performed by relatively rotating the camshaft 97 so that the opening-and-closing timing of the exhaust valve 91 is made early.

The valve timing control apparatus 10 retards the opening-and-closing timing of the exhaust valve 91 by rotating the camshaft 97 in an opposite direction opposite to the rotational direction relative to the sprocket 95. The retard operation is performed by relatively rotating the camshaft 97 so that the opening-and-closing timing of the exhaust valve 91 is made late.

Figure 3:
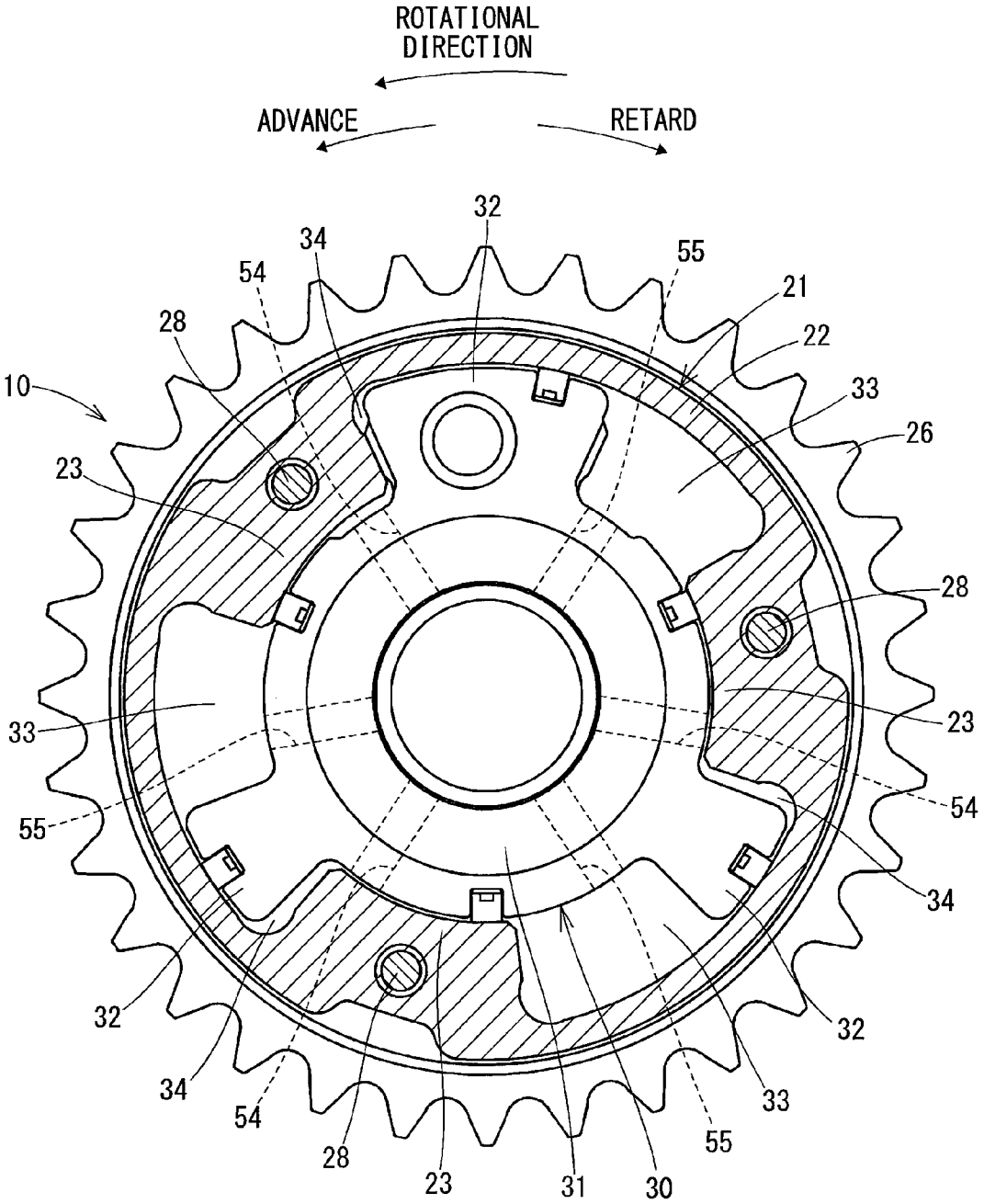
FIG. 3 is a cross-sectional view taken along a line III-Ill in FIG. 1, in which illustration of a direction switch valve is omitted.

The valve timing control apparatus 10 is explained with reference to FIG. 1 and FIG. 3. The valve timing control apparatus 10 includes a housing 20, a vane rotor 30, a sleeve bolt 35, and a spool 40.

The housing 20 has a case 21 having a based cylindrical shape in addition to the sprocket 26. Specifically, the case 21 has a pipe part 22 and a bottom part 24. Plural partition parts 23 are projected inward from the pipe part 22, and the bottom part 24 has a through hole 25 at the center. The sprocket 26 is combined to the open end of the case 21, and has a through hole 27 through which the camshaft 97 passes. The case 21 and the sprocket 26 are coaxially arranged as the camshaft 97, and are mutually fixed to each other with a bolt 28.

The vane rotor 30 has a boss 31 having a cylindrical shape and plural vanes 32. The boss 31 is rotatably arranged on the inner side of the partition part 23 of the case 21. The boss 31 is fixed to the camshaft 97 with the sleeve bolt 35. The vane 32 is projected outward in the radial direction from the boss 31, and divides a space partitioned by the partition parts 23 of the case 21 into an advance chamber 33 and a retard chamber 34. The advance chamber 33 is located on opposite side from the vane 32 in the rotational direction, and the retard chamber 34 is located adjacent to the vane 32 in the rotational direction. The vane rotor 30 has a relative rotation relative to the housing 20 on the advance side or the retard side according to the oil pressure in the advance chamber 33 and the retard chamber 34.

The sleeve bolt 35 is a half-screw type bolt having a sleeve part 38 between a head part 36 part and a screw part 37. The sleeve part 38 has a cylindrical shape extending from the central part of the vane rotor 30 in the axial direction into a blind hole 87 opened on the end surface of the camshaft 97. The sleeve part 38 may correspond to a sleeve. The screw part 37 is tightened to a screw hole 88 defined in the bottom part of the blind hole 87. The sleeve part 38 has plural radial ports passing through the sleeve part in the radial direction.

The spool 40 is movable in the axial direction in a spool accommodation hole 39 of the sleeve part 38 having a based cylindrical shape. A stopper plate 41 is fitted to the open end of the spool accommodation hole 39, and the spool 40 is biased by a spring 42 toward the stopper plate 41. A linear solenoid 89 is arranged opposite to the spool 40 through the stopper plate 41. The axial position of the spool 40 is determined by balance between the thrust force of the linear solenoid 89 and the biasing force of the spring 42.

The sleeve part 38 of the sleeve bolt 35 and the spool 40 construct a direction switch valve 45. The direction switch valve 45 switches the communication/interception state between the ports of the sleeve part 38 according to the axial position of the spool 40. While operation oil is supplied to one of the advance chamber 33 and the retard chamber 34, operation oil can be discharged from the other of the advance chamber 33 and the retard chamber 34. Alternatively, operation oil can be held in the advance chamber 33 and the retard chamber 34.

The valve timing control apparatus 10 discharges operation oil from the retard chamber 34 and supplies operation oil to the advance chamber 33, when the rotation phase of the camshaft 97 is on the retard side from a desired value. Thereby, the vane rotor 30 is rotated relative to the housing 20 on the advance side.

The valve timing control apparatus 10 discharges operation oil from the advance chamber 33 and supplies operation oil to the retard chamber 34, when the rotation phase of the camshaft 97 is on the advance side from a desired value. Thereby, the vane rotor 30 is rotated relative to the housing 20 on the retard side.

The valve timing control apparatus 10 holds the operation oil in the advance chamber 33 and the retard chamber 34, when the rotation phase of the camshaft 97 is in agreement with a desired value. Thereby, the rotation phase of the vane rotor 30 and the housing 20 is held.

Figure 4:
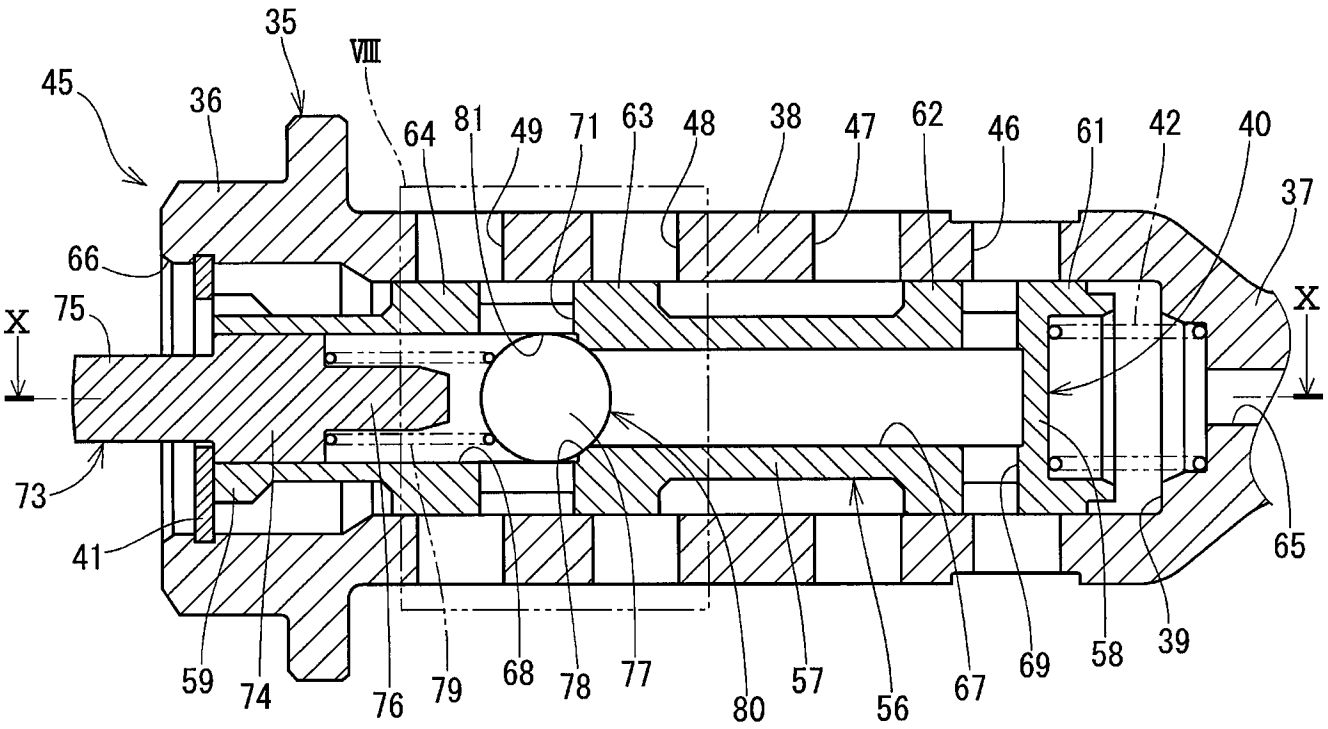
FIG. 4 is an enlarged view illustrating the direction switch valve of FIG. 1, in which the direction switch valve is in an advance operation state and the check valve closes a passage.

Details of the direction switch valve 45 are explained with reference to FIGS. 1 and 4-8. As shown in FIG. 4, the sleeve part 38 of the sleeve bolt 35 has a supply port 46, a drain port 47, an advance port 48, and a retard port 49 in this order from a side of the screw part 37. The supply port 46 is connected with the discharge part of the oil pump 52 through the supply passage 51 defined in, for example, a cylinder head. The drain port 47 is connected with an external drain space through the drain passage 53. The retard port 49 is connected with the retard chamber 34 through the retard passage 54 defined in the vane rotor 30. The advance port 48 is connected with the advance chamber 33 through the advance passage 55 defined in the vane rotor 30. The retard port 49 and the advance port 48 may correspond to a discharge port.

The spool 40 has a based cylindrical component 56 and a plug component 73. The based cylindrical component 56 has a pipe part 57 coaxially arranged with the sleeve part 38, and a bottom part 58 located between the screw part 37 of the sleeve bolt 35 and the pipe part 57. The spool 40 is able to move in the axial direction from a position shown in FIG. 4 where the open end 59 of the pipe part 57 of the based cylindrical component 56 is in contact with the stopper plate 41 through an intermediate position shown in FIG. 5 to a position shown in FIG. 6 where the bottom part 58 of the based cylindrical component 56 is in contact with the screw part 37 of the sleeve bolt 35.

The based cylindrical component 56 further has a first partition part 61, a second partition part 62, a third partition part 63, and a fourth partition part 64 in this order from a side of the bottom part. Each of the partition parts is a circular projection projected outward in the radial direction from the pipe part 57 or the bottom part 58. The screw part 37 of the sleeve bolt 35 has a hole 65 extending in the axial direction.

The first partition part 61 is positioned in a space defined by the sleeve part 38 of the sleeve bolt 35 and the bottom part 58 of the based cylindrical component 56 to partition the hole 65 and the supply port 46 from each other. The second partition part 62 is positioned in a space defined by the sleeve part 38 of the sleeve bolt 35 and the pipe part 57 of the based cylindrical component 56 to partition the supply port 46 and the drain port 47 from each other.

The third partition part 63 is positioned in the space defined by the sleeve part 38 of the sleeve bolt 35 and the pipe part 57 of the based cylindrical component 56 to partition the drain port 47 and the retard port 49 from each other and to partition the retard port 49 and the advance port 48 from each other.

The fourth partition part 64 is positioned in the space defined by the sleeve part 38 of the sleeve bolt 35 and the pipe part 57 of the based cylindrical component 56 to partition the retard port 49 and the advance port 48 from each other and to partition the advance port 48 and the opening 66 of the spool accommodation hole 39 from each other.

The pipe part 57 has a first axial direction hole 67 which extends in the axial direction between the valve seat 78 and the bottom part 58, and a second axial direction hole 68 which extends in the axial direction between the valve seat 78 and the open end portion 59. The inside diameter of the second axial direction hole 68 is made larger than that of the first axial direction hole 67. In other words, the inside diameter is changed at a point between the first axial direction hole 67 and the second axial direction hole 68 to have a stepped shape.

The pipe part 57 further has a supply hole 69 and a discharge hole 71. The supply hole 69 passes through the pipe part 57 from the first axial direction hole 67 towards outside and is located between the first partition part 61 and the second partition part 62. The discharge hole 71 passes through the pipe part 57 from the second axial direction hole 68 towards outside and is located between the third partition part 63 and the fourth partition part 64. The supply hole 69 is communicated to the supply port 46 irrespective of the axial position of the spool 40. The discharge hole 71 is able to communicate with one of the advance port 48 and the retard port 49 according to the axial position of the spool 40.

The supply hole 69, the first axial direction hole 67, the second axial direction hole 68, and the discharge hole 71 are communicated with each other so as to define a connection passage 72 which connects the supply port 46 to the advance port 48 or the retard port 49 according to the axial position of the spool 40.

As shown in FIG. 1 and FIG. 4, the plug component 73 has a press fit part 74, a pressure part 75, and a stopper part 76. The press fit part 74 is pressingly fitted into the open end portion 59 of the pipe part 57 of the spool 40. The pressure part 75 is projected toward the linear solenoid 89 from the press fit part 74. The stopper part 76 is projected into the second axial direction hole 68 from the press fit part 74. The linear solenoid 89 presses the spool 40 by contacting the pressure part 75 corresponding to a contact part. The plug component 73 and the based cylindrical component 56 are integrally formed as one-piece component, and are able to move in the axial direction by pressurized by the linear solenoid 89.

Figure 7:
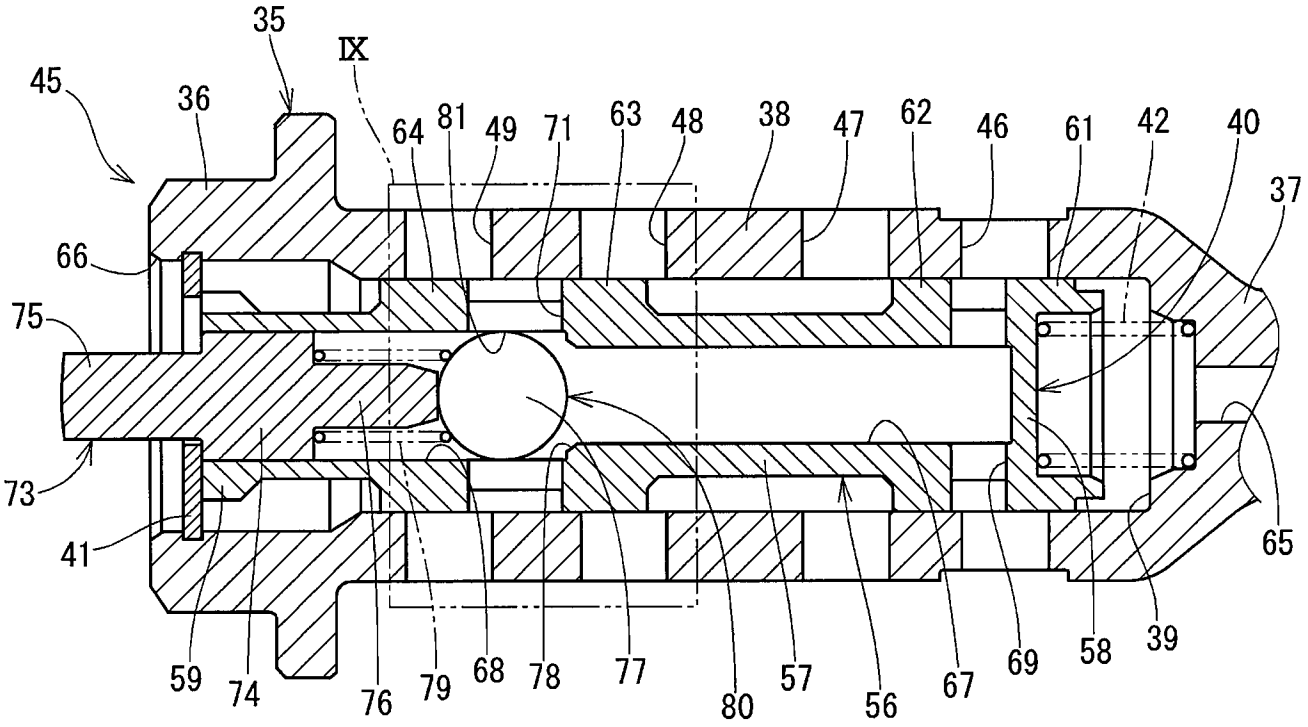
FIG. 7 is an enlarged view illustrating the direction switch valve of FIG. 1, in which the direction switch valve is in an advance operation state and the check valve opens a passage.

A spherical valve object 77 is disposed in the second axial direction hole 68 of the pipe part 57 of the based cylindrical component 56. The valve object 77 is able to seat on or separate from a valve seat 78 defined at a position between the second axial direction hole 68 and the first axial direction hole 67 where the inside diameter is changed. When the valve object 77 is seated to the valve seat 78 as shown in FIG. 4, operation oil is prevented from flowing from the discharge hole 71 to the supply hole 69 in the connection passage 72. When the valve object 77 is separated from the valve seat 78 as shown in FIG. 7, operation oil is allowed to flow to the discharge hole 71 from the supply hole 69. A check valve 80 is constructed by the valve object 77, the spool 40 and the spring 79 which biases the valve object 77 toward the valve seat 78, and regulates the flow of the operation oil in the connection passage 72 to flow only in one direction.

When the spool 40 is in contact with the stopper plate 41 as shown in FIG. 4, the spool 40 is defined to be located at an original position in the axial direction. When the spool 40 is at the original position in the axial direction, the supply port 46 is able to communicate with the advance port 48 through the connection passage 72, and the retard port 49 is communicated with the drain port 47. At this time, when operation oil is supplied from the supply port 46, the check valve 80 is opened with the flow pressure of operation oil, and the supply port 46 and the advance port 48 communicate with each other. Then, operation oil is discharged from the retard chamber 34 while operation oil is supplied to the advance chamber 33, such that the vane rotor 30 is rotated on the advance side relative to the housing 20 in an advance operation state.

Figure 5:
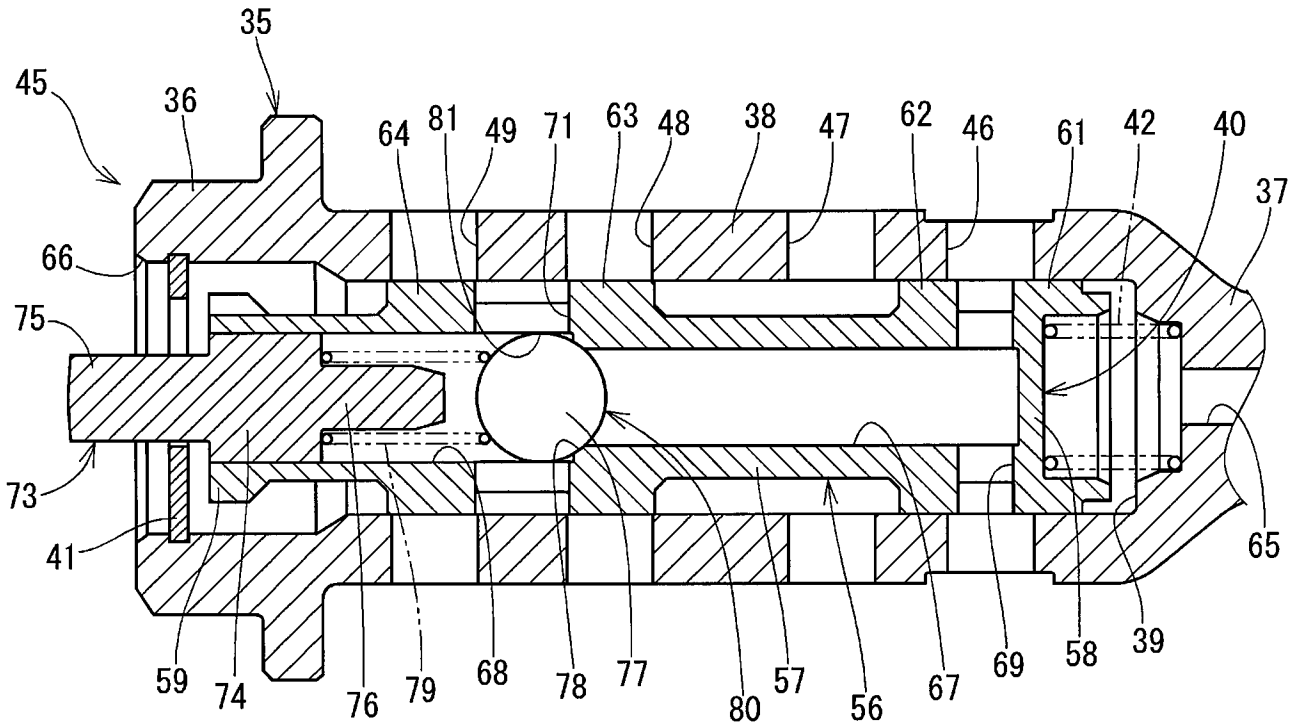
FIG. 5 is an enlarged view illustrating the direction switch valve of FIG. 1, in which the direction switch valve is in a hold operation state and the check valve closes a passage.

As shown in FIG. 5, when the spool 40 moves by a predetermined distance from the original position, mutual communication is intercepted among the supply port 46, the retard port 49, and the advance port 48. At this time, the operation oil is held in the advance chamber 33 and the retard chamber 34. Thereby, relative rotation between the vane rotor 30 and the housing 20 is prevented, and the rotation phase is held in a hold operation state.

Figure 6:
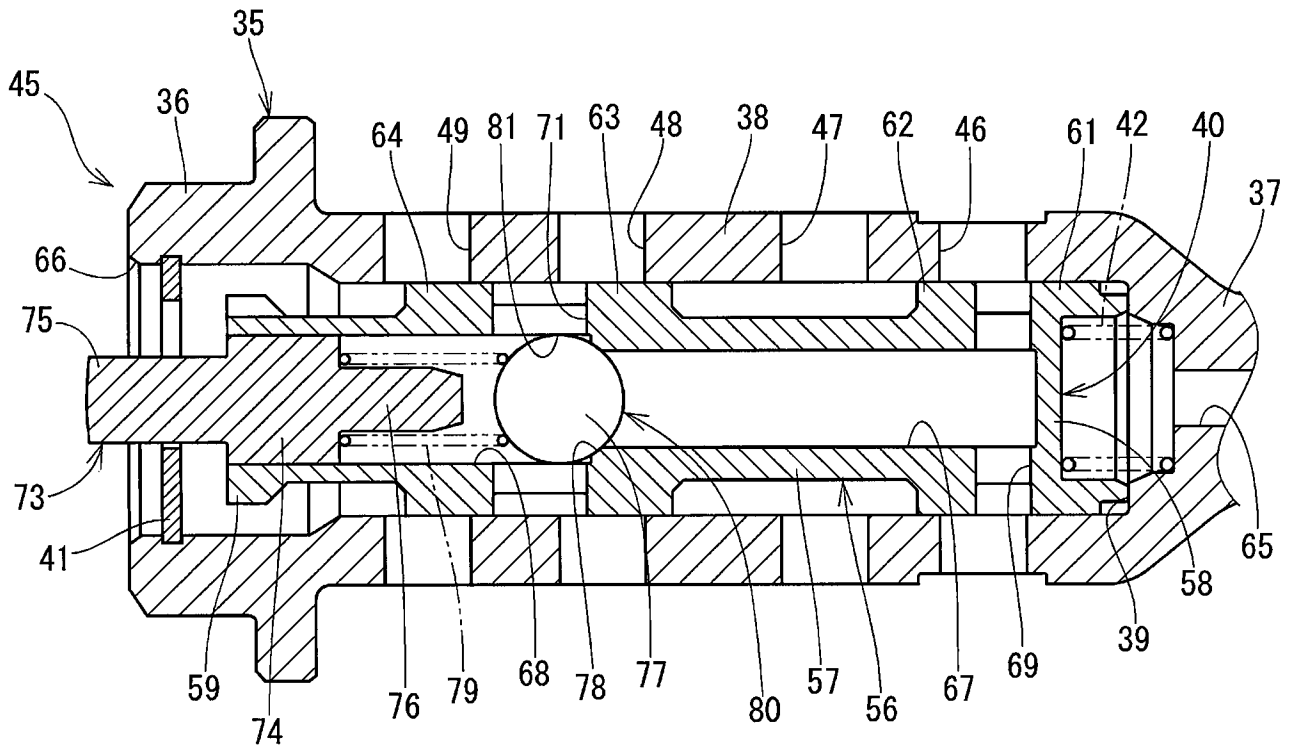
FIG. 6 is an enlarged view illustrating the direction switch valve of FIG. 1, in which the direction switch valve is in a retard operation state and the check valve closes a passage.

As shown in FIG. 6, when the spool 40 further moves by a predetermined distance toward the screw part 37 from the hold operation state and when the spool 40 contacts the bottom surface of the spool accommodation hole 39, the supply port 46 is communicated with the retard port 49 through the connection passage 72, and the advance port 48 is communicated with the opening 66 of the spool accommodation hole 39. Then, operation oil is discharged from the advance chamber 33 while operation oil is supplied to the retard chamber 34, such that the vane rotor 30 is rotated on the retard side relative to the housing 20 in a retard operation state.

Details of the check valve 80 are explained with reference to FIGS. 8-10.

Figure 8:
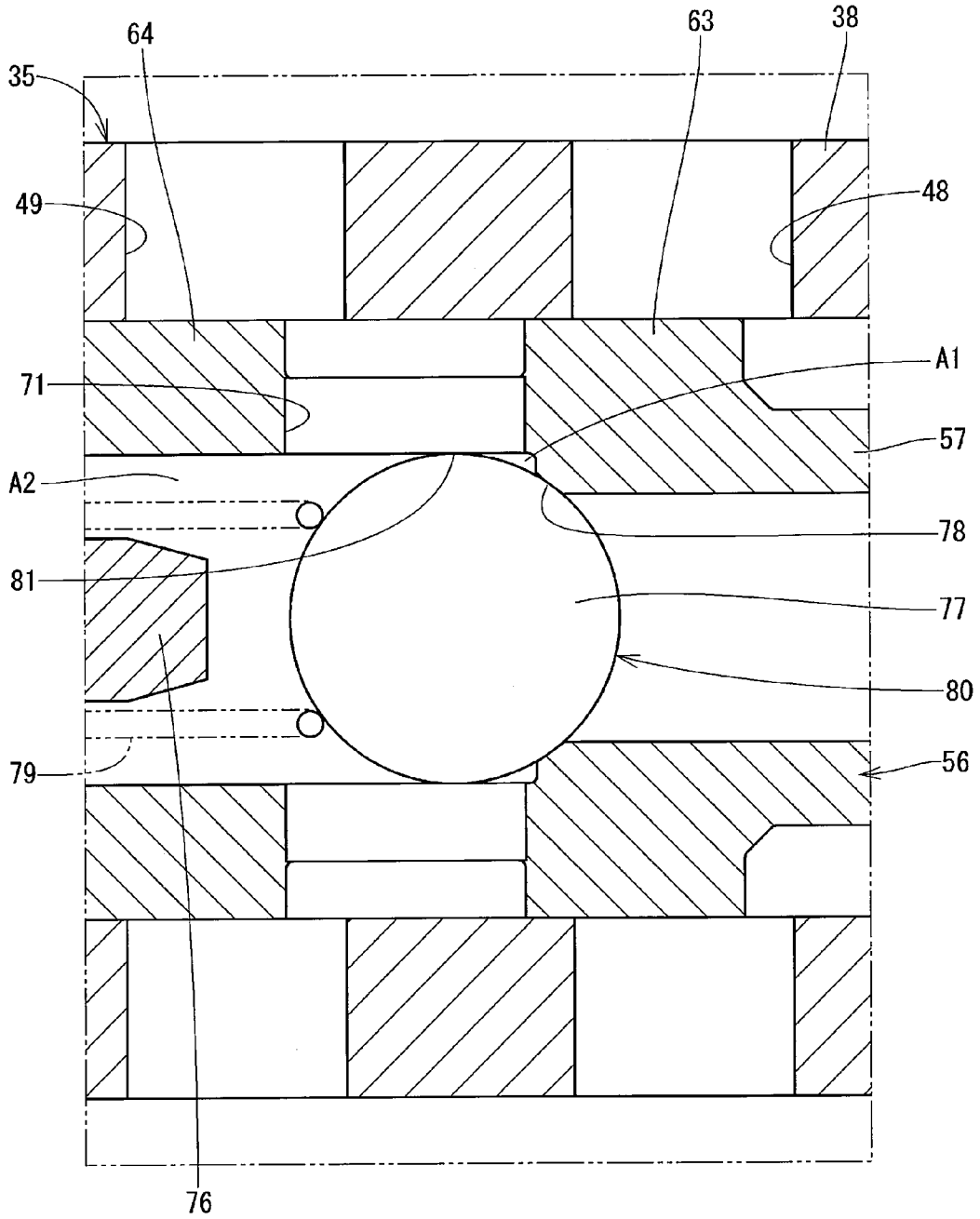
FIG. 8 is an enlarged view illustrating an area VIII of FIG. 4.

As shown in FIG. 8, the inner wall surface of the based cylindrical component 56 which defines the second axial direction hole 68 has the guide surface 81 guiding the valve object 77 to move in the axial direction while restraining the valve object 77 in the radial direction. That is, the inside diameter of the guide surface 81 is set to be approximately the same as the outer diameter of the valve object 77.

Figure 9:
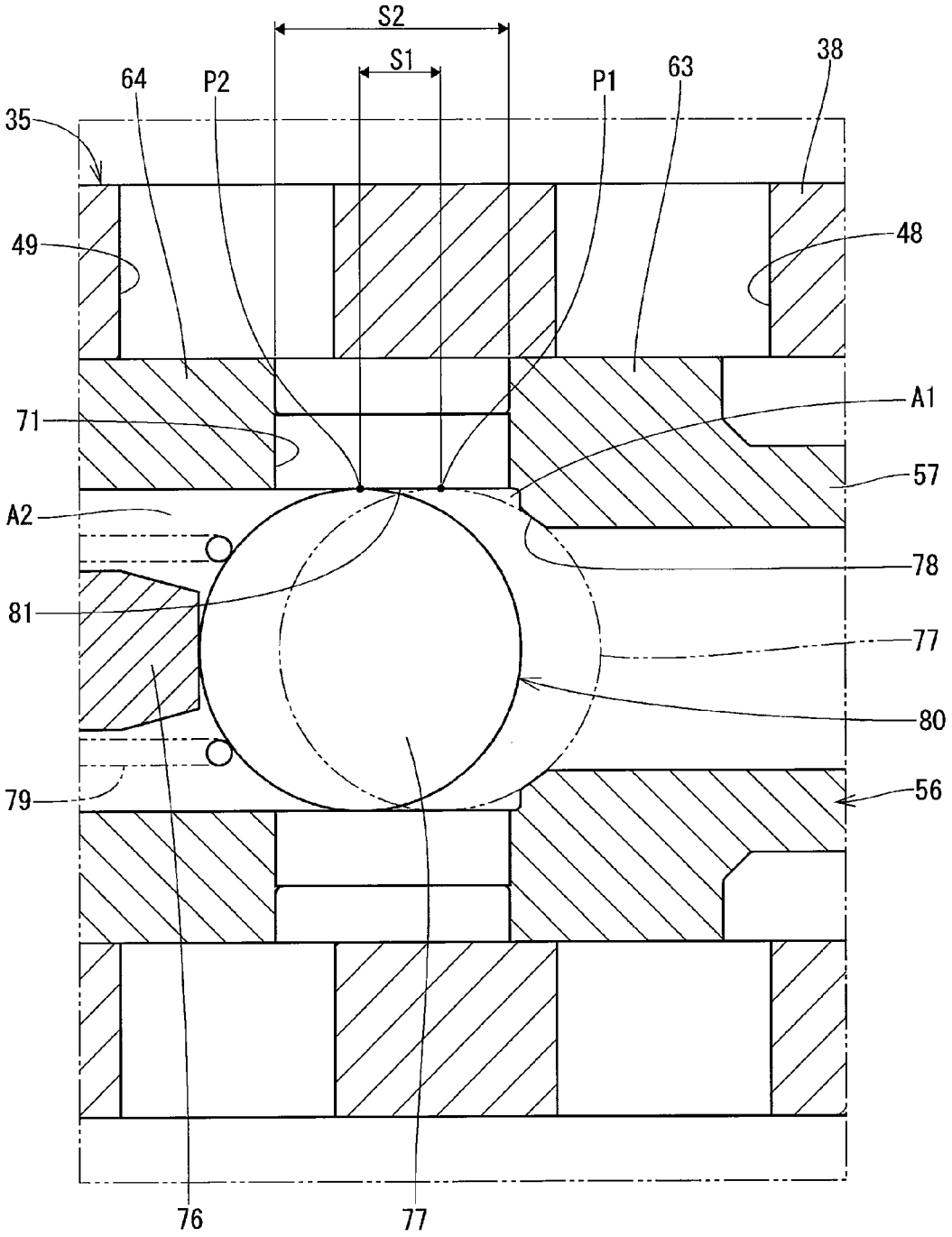
FIG. 9 is an enlarged view illustrating an area IX of FIG. 7.

A double chain line in FIG. 9 represents the position of the valve object 77 seated to the valve seat as a fully closed position, and a solid line in FIG. 9 represents the position of the valve object 77 separated from the valve seat and in contact with the stopper part 76 of the plug component 73 as a fully opened position.

A stroke range S1 of the valve object 77 is defined from a slide-contact position P1 at which the guide surface 81 and the valve object 77 located at the fully closed position are in contact with each other to a slide-contact position P2 at which the guide surface 81 and the valve object 77 located at the fully opened position are in contact with each other. The discharge hole 71 of the based cylindrical component 56 is opened in the guide surface 81 with an open range S2 that is larger than the stroke range S1. In other words, the open range S2 spreads from the stroke range S1 toward the valve seat 78 and toward the stopper part 76, as shown in FIG. 9.

Thereby, a space A1 of the second axial direction hole 68 adjacent to the valve seat 78 with respect to the valve object 77, and a space A2 of the second axial direction hole 68 adjacent to the stopper part 76 with respect to the valve object 77 are always communicated with the discharge hole 71 irrespective of the position of the valve object 77.

Figure 10:
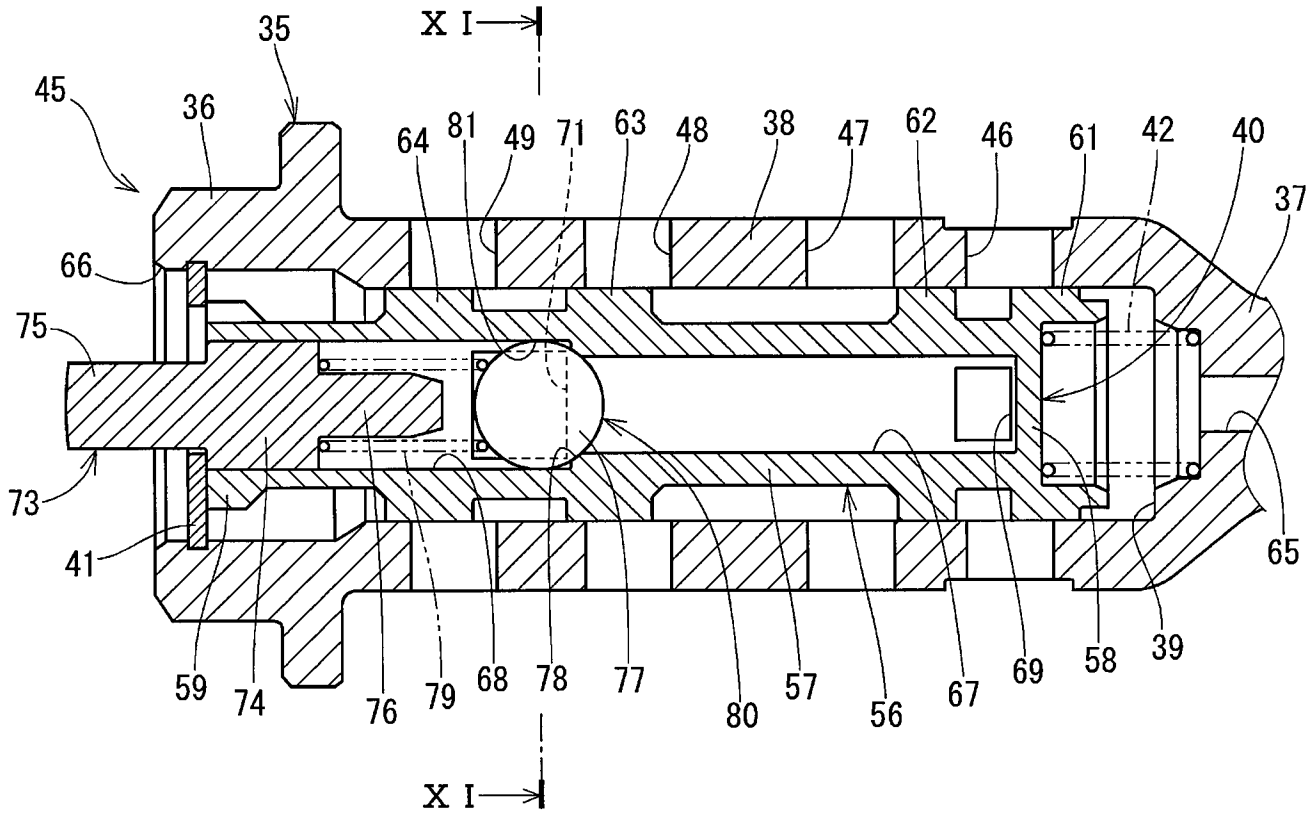
FIG. 10 is a cross-sectional view taken along a line X-X in FIG. 4.
Figure 11:
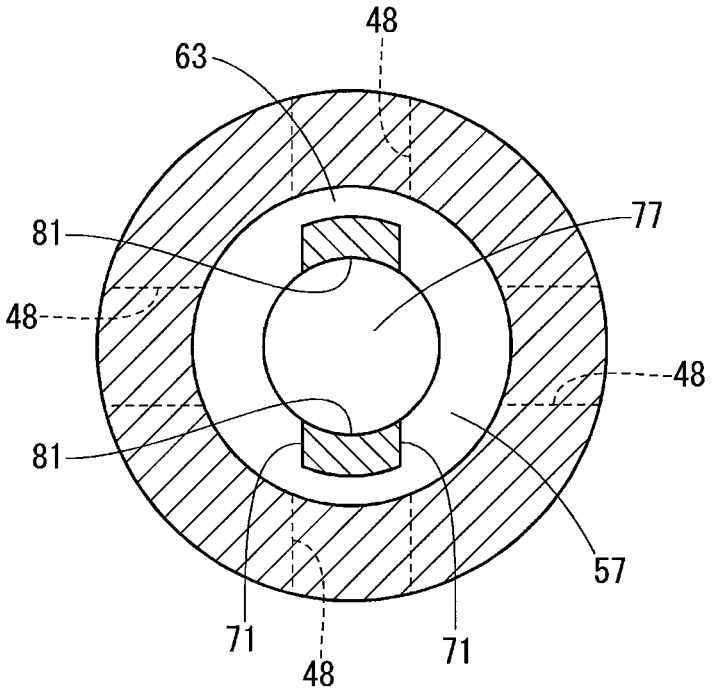
FIG. 11 is a cross-sectional view taken along a line XI-XI in FIG. 10.

As shown in FIG. 10 and FIG. 11, the discharge hole 71 defined on the guide surface 81 has a rectangular shape, as a passage cross-section shape.

The positional relationship between the discharge hole 71 and the supply hole 69 is shown in FIG. 10. The open position of the discharge hole 71 at the inner wall surface of the spool 40 is the same as that of the supply hole 69 in the circumferential direction. That is, when the spool 40 is seen in the axial direction, the discharge hole 71 and the supply hole 69 of the based cylindrical component 56 are opened in the same direction. In other words, the discharge hole 71 and the supply hole 69 extend in the same direction.

The first axial direction hole 67 of the based cylindrical component 56 and the valve object 77 are located to have the same axis.

The valve seat 78 is a part of the inner wall of the based cylindrical component 56. That is, the valve seat 78 is integrally formed with the based cylindrical component 56 as one-piece component.

According to the present embodiment, the inner wall surface of the based cylindrical component 56 which defines the second axial direction hole 68 has the guide surface 81 in which the discharge hole 71 is opened, and the guide surface 81 guides the valve object 77 to move in the axial direction while restraining the valve object 77 in the radial direction.

Thus, when the valve object 77 is separated from the valve seat 78, operation oil can flow into an oil pressure chamber through a portion of the discharge holes 71 that is opened at a position adjacent to the valve seat 78 with respect to the slide-contact part between the valve object 77 and the guide surface 81. Therefore, the check valve 80 can be constituted without preparing a clearance between the guide surface 81 and the valve object 77. Accordingly, the radial dimension of the check valve 80 can be made smaller, and the size of the direction switch valve 45 can be made smaller.

Moreover, the valve seat 78 and the valve object 77 are located at approximately the same position in the axial direction as the discharge hole 71 of the connection passage 72. Therefore, when operation oil flows backwards from the advance chamber 33 or the retard chamber 34 toward the oil pump 52, a variation in the oil pressure is transmitted to the check valve 80 comparatively for a short time. Accordingly, the response of the check valve 80 can be improved.

Moreover, the discharge hole 71 of the based cylindrical component 56 is opened on the guide surface 81 with the open range S2 that is larger than the stroke range S1 of the valve object 77 toward the valve seat 78 and toward the stopper part 76. Thereby, the space A1 of the second axial direction hole 68 adjacent to the valve seat 78 relative to the valve object 77 is always communicated with the discharge hole 71 irrespective of the position of the valve object 77. Therefore, the supply hole 69 and the discharge hole 71 can be communicated with each other immediately after the check valve 80 opens the passage.

Moreover, the space A2 of the second axial direction holes 68 adjacent to the stopper part 76 relative to the valve object 77 is always communicated with the discharge hole 71 irrespective of the position of the valve object 77. Therefore, the space A2 is filled with operation oil, and the force applied on the valve object 77 from the operation oil of the space A2 can be used for closing the check valve 80, so the response of the check valve 80 can be improved.

Moreover, the discharge hole 71 defined in the guide side 81 has a rectangle shape. Therefore, as compared with a case where the discharge hole has a circle shape, the passage sectional area immediately downstream of the check valve 80 becomes large, so a large flow rate can be obtained.

Moreover, when the spool 40 is seen in the axial direction, the discharge hole 71 and the supply hole 69 of the based cylindrical component 56 are opened in the same direction. Furthermore, the first axial direction hole 67 of the based cylindrical component 56 and the valve object 77 are located to have the same axis. Therefore, the flow place formed in the connection passage 72 can be stabilized, and pressure loss in the connection passage 72 can be made low.

In case where the valve seat of the check valve is constituted from an another component different from the spool, the valve seat receives force from the valve object when the check valve is closed, such that the valve seat may move relative to the spool according to the force.

In contrast, according to the present embodiment, the valve seat 78 is integrally formed with the based cylindrical component 56 as one-piece component. Therefore, the valve seat can be restricted from being moved relative to the spool.

Moreover, since the valve seat 78 is integrally formed with the based cylindrical component 56 which is made of material having high hardness, high wear resistance can be obtained.

OTHER EMBODIMENT

The vane rotor may be fixed to the camshaft by other method such as press-fitting, not limited to the screw tightening. In this case, the sleeve of the direction switch valve may not be formed integrally with the bolt.

The ports of the sleeve may be arranged in other order in the axial direction.

The valve object of the check valve may not be sphere, and may have other shape such as cylindrical shape, for example.

The discharge hole of the spool is opened in the guide surface to overlap with at least a part of the stroke range of the valve object of the check valve.

The open shape of the discharge hole in the guide surface of the spool may be other shape such as circle other than the rectangle. In the case where the open shape of the discharge hole is rectangle, the corner angle may be round.

The discharge hole and the supply hole of the spool may be opened in directions different from each other when the spool is seen in the axial direction.

The valve object of the check valve may be located to have an axis different from the axis of the first axial direction hole of the spool.

The valve seat of the check valve may be made of another component different from the spool.

The valve timing control apparatus may adjust the opening-and-closing timing of the intake valve of the engine.

Such changes and modifications are to be understood as being within the scope of the present disclosure as defined by the appended claims.

What is claimed is:

1. A valve timing control apparatus disposed in a power train from a driving shaft of an internal combustion engine to a driven shaft opening and closing at least one of an intake valve and an exhaust valve so as to control opening-and-closing timing of the intake valve or the exhaust valve by changing a rotation phase between the driving shaft and the driven shaft, the valve timing control apparatus comprising:

a housing that integrally rotates with one of the driving shaft and the driven shaft;

a vane rotor that integrally rotates with the other of the driving shaft and the driven shaft, the vane rotor defining an oil pressure chamber in the housing, the vane rotor being rotated relative to the housing by operation oil supplied to the oil pressure chamber;

a sleeve having a cylindrical shape extending in an axial direction at a central part of the vane rotor, the sleeve having a supply port communicating with an external oil supply source, and a discharge port communicating with the oil pressure chamber, a spool that moves in the sleeve in the axial direction, the spool having a connection passage that connects the supply port and the discharge port with each other according to a position of the spool in the axial direction;

a valve seat arranged in the connection passage;

a valve object that is seated on or separated from the valve seat, the valve object being seated on the valve seat to restrict the operation oil from flowing from the discharge port to the supply port; and a spring that biases the valve object toward the valve seat, the valve object being located between the spring and the valve seat, wherein the connection passage has a first axial direction hole extended to one side in the axial direction relative to the valve seat, a supply hole passing through the spool in a radial direction from the first axial direction hole so as to communicate with the supply port, a second axial direction hole extended to the other side in the axial direction relative to the valve seat, and a discharge hole passing through the spool in the radial direction from the second axial direction hole, the discharge hole communicating with the discharge port according to a position of the spool in the axial direction, the spool has an inner surface that defines the second axial direction hole, and the inner surface of the spool has a guide surface that guides the valve object to move in the axial direction while restricting a position of the valve object in the radial direction, the discharge hole is opened on the guide surface, the spool has a stopper part that regulates the valve object from moving in a valve-open direction at a position opposite from the valve seat through the valve object, the valve object is located at a fully closed position when the valve object is seated on the valve seat, the valve object is located at a fully opened position where the valve object is in contact with the stopper part of the spool when the valve object is separated from the valve seat, the valve object has a stroke range defined between a slide-contact position at which the guide surface and the valve object located at the fully closed position are in contact with each other and a slide-contact position at which the guide surface and the valve object located at the fully opened position are in contact with each other, the discharge hole is positioned such that a part of the discharge hole overlaps with the stroke range, and when the valve object moves between the fully closed position and the fully opened position, the discharge hole continues to communicate with a space receiving the stopper part and the spring.

2. The valve timing control apparatus according to claim 1, wherein the discharge hole has an open range opened on the guide surface, the open range of the discharge hole is larger than the stroke range, and the open range of the discharge hole spreads toward the valve seat and toward the stopper part from the stroke range.

3. The valve timing control apparatus according to claim 1, wherein the discharge hole has a rectangle shape opened on the guide surface.

4. The valve timing control apparatus according to claim 1, wherein the discharge hole and the supply hole are opened in the same direction when the spool is seen in the axial direction.

5. The valve timing control apparatus according to claim 1, wherein the first axial direction hole and the valve object are located to have the same axis.

6. The valve timing control apparatus according to claim 1, the valve seat is integrally formed with the spool.

7. The valve timing control apparatus according to claim 1, wherein the valve object has an external diameter that is equal to an internal diameter of the guide surface, such that there is no clearance between the valve object and the guide surface.

8. The valve timing control apparatus according to claim 1, wherein the stopper part is projected toward the valve object from a press fit part fitted to an open end portion of the spool.

9. The valve timing control apparatus according to claim 1, wherein the second axial direction hole has a first space defined between the valve seat and the valve object, and a second space defined between the stopper part and the valve object, and the first space and the second space are communicated with the discharge hole irrespective of a position of the valve object.

10. The valve timing control apparatus according to claim 1, wherein the valve object has an external diameter that is equal to an internal diameter of the second axial direction hole, and is smaller than an internal diameter of the first axial direction hole, and the internal diameter of the first axial direction hole is larger than a dimension of the stopper part in the radial direction, and is larger than a dimension of the spring in the radial direction.

* * * * *